US009311839B2

(12) United States Patent
Xu et al.

(10) Patent No.: US 9,311,839 B2
(45) Date of Patent: Apr. 12, 2016

(54) METHOD FOR DRIVING LIQUID CRYSTAL PANEL, METHOD FOR TESTING FLICKER AND LIQUID CRYSTAL DISPLAY APPARATUS

(71) Applicants: Boe Technology Group Co., Ltd., Beijing (CN); Beijing Boe Display Technology Co., Ltd., Beijing (CN)

(72) Inventors: Yizhen Xu, Beijing (CN); Zhihua Sun, Beijing (CN); Xingji Wu, Beijing (CN); Jianming Wang, Beijing (CN); Liang Zhang, Beijing (CN)

(73) Assignees: BOE TECHNOLOGY GROUP CO., LTD., Beijing (CN); Beijing BOE Display Technology Co., Ltd., Beijing (CN)

( * ) Notice: Subject to any disclaimer, the term of this patent is extended or adjusted under 35 U.S.C. 154(b) by 178 days.

(21) Appl. No.: 14/100,759

(22) Filed: Dec. 9, 2013

(65) Prior Publication Data

US 2014/0184967 A1 Jul. 3, 2014

(30) Foreign Application Priority Data

Dec. 11, 2012 (CN) ..... 2012 1 0534068

(51) Int. Cl.
*G09G 3/36* (2006.01)
*G09G 3/00* (2006.01)

(52) U.S. Cl.
CPC ..... *G09G 3/006* (2013.01); *G09G 3/3614* (2013.01); *G09G 2300/0426* (2013.01); *G09G 2320/0247* (2013.01); *G09G 2370/14* (2013.01)

(58) Field of Classification Search
CPC . G09G 3/006; G09G 3/3614; G09G 2370/14; G09G 2320/0247; G09G 2300/0426
USPC ..... 345/209, 96
See application file for complete search history.

(56) References Cited

U.S. PATENT DOCUMENTS 8,451,203 B2 * 5/2013 Kao ..... G09G 3/3614 345/90
2004/0252098 A1 * 12/2004 Lee ..... G09G 3/3648 345/103

(Continued)

FOREIGN PATENT DOCUMENTS

CN 101840670 A 9/2010
CN 102708817 A 10/2012
KR 1020080079948 A * 9/2008 ..... G09G 3/3614

OTHER PUBLICATIONS

English translation of Office Action dated May 28, 2014, for corresponding Chinese Application No. 2012105340689.

*Primary Examiner* — Kwang-Su Yang
(74) *Attorney, Agent, or Firm* — Kinney & Lange, P.A.

(57) ABSTRACT

A method for driving a liquid crystal panel, a method for testing flicker and a liquid crystal display apparatus are disclosed. They relate to the technical field of liquid crystal display. By changing the driving mode of polarity inversion, it is achieved that the flicker test is performed on the liquid crystal panel with the Z inversion array arrangement on basis of the flicker test pattern of 1+2H. In two adjacent columns of pixel units in the plurality of pixel units, one column common data line is connected with the pixel electrodes located at the opposed sides of the common data line alternatively through the thin film transistors. The method for driving the liquid crystal panel comprises: applying the data line driving signals with opposed polarities to the odd columns of data lines and the even columns of data lines within one frame of picture, wherein the polarities of the data line driving signals are inversed, each time two rows of the gate lines have been scanned, to form a specific polarity arrangement, the initial data line driving signals for two adjacent frames of pictures have opposed polarities.

6 Claims, 5 Drawing Sheets

(56) References Cited

U.S. PATENT DOCUMENTS

2005/0104834 A1* 5/2005 Tsuchihashi ..... G09G 3/3614 345/96
2007/0229433 A1 10/2007 Jang
2008/0001888 A1* 1/2008 Lee ..... G09G 3/3688 345/96
2011/0164076 A1 7/2011 Lee
2012/0256885 A1* 10/2012 Kwon ..... G09G 3/3614 345/204

* cited by examiner

| R | G | B | R | G | B | R | G | B | R | G | B |
|---|---|---|---|---|---|---|---|---|---|---|---|
| + | − | + | − | + | − | + | − | + | − | + | − |
| − | + | − | + | − | + | − | + | − | + | − | + |
| − | + | − | + | − | + | − | + | − | + | − | + |
| + | − | + | − | + | − | + | − | + | − | + | − |
| + | − | + | − | + | − | + | − | + | − | + | − |
| − | + | − | + | − | + | − | + | − | + | − | + |
| − | + | − | + | − | + | − | + | − | + | − | + |
| + | − | + | − | + | − | + | − | + | − | + | − |
| + | − | + | − | + | − | + | − | + | − | + | − |
| − | + | − | + | − | + | − | + | − | + | − | + |
| − | + | − | + | − | + | − | + | − | + | − | + |
| + | − | + | − | + | − | + | − | + | − | + | − |

Fig. 3 Prior Art

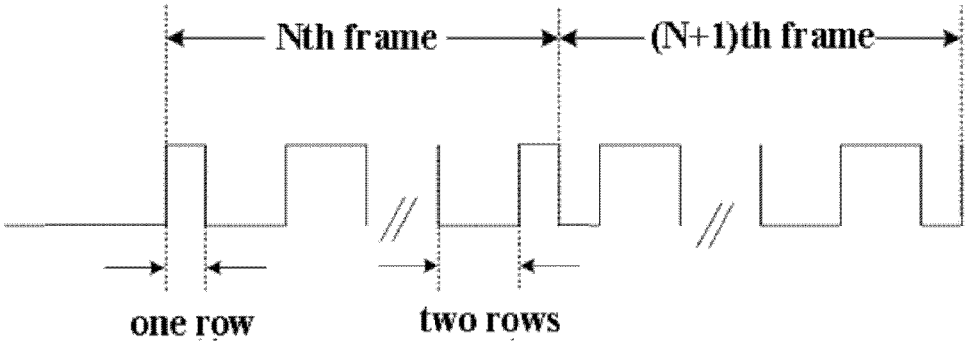

Fig. 4 Prior Art

| R | G | B | R | G | B | R | G | B | R | G | B |
|---|---|---|---|---|---|---|---|---|---|---|---|
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |

Fig. 5 Prior Art

Nth frame

| R | G | B | R | G | B | R | G | B | R | G | B |
|---|---|---|---|---|---|---|---|---|---|---|---|
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |

→

(N+1)th frame

| R | G | B | R | G | B | R | G | B | R | G | B |
|---|---|---|---|---|---|---|---|---|---|---|---|
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |

Fig. 6

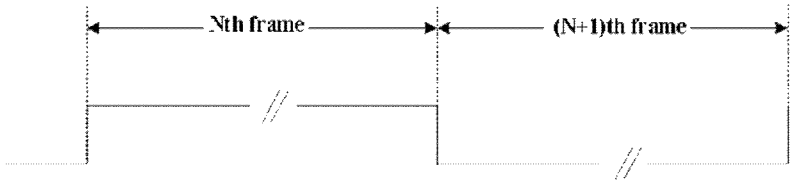

Fig. 7

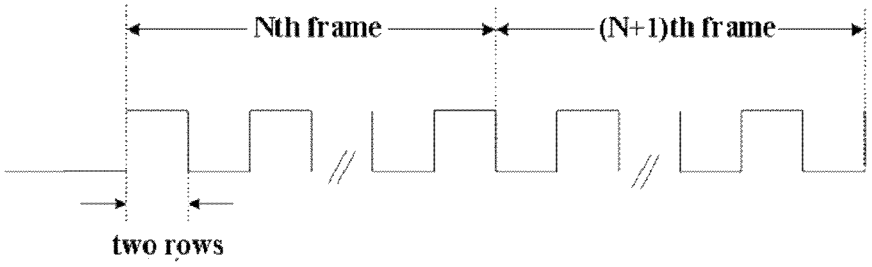

Fig. 8

METHOD FOR DRIVING LIQUID CRYSTAL PANEL, METHOD FOR TESTING FLICKER AND LIQUID CRYSTAL DISPLAY APPARATUS

CROSS-REFERENCE TO RELATED APPLICATION

This application claims the benefit of Chinese Patent Application No. 201210534068.9 filed on Dec. 11, 2012 in the State Intellectual Property Office of China, the whole disclosure of which is incorporated herein by reference.

BACKGROUND OF THE INVENTION

1. Field of the Invention

The present invention relates to a display technical field, more particularly, relates to a method for driving a liquid crystal display panel, a method for testing flicker and a liquid crystal display apparatus.

2. Description of the Related Art

As the display technology develops, the liquid crystal display (LCD) becomes more and more popular due to its advantages such as lightness, low irradiation. However, there is a defect of poor flicker in the conventional LCD. In view of this, it is desired to perform a flicker test on the LCD and adjust the voltages of common electrodes of the liquid crystal in LCD on basis of the testing results in order to reduce the flicker.

The modes of arrangement of array substrate in the conventional liquid crystal panel include a normal array arrangement as shown in FIG. 1 and a Z inversion array arrangement as shown in FIG. 2. In the liquid crystal panel with the Z inversion array arrangement, each pixel unit includes a thin film transistor and one pixel electrode. Two adjacent columns of pixel units have a common data line which is connected with the pixel electrodes on opposed sides of the common data line alternatively through the thin film transistors. In this way, the pixel electrode and the thin film transistor located at the Ith row and the Jth column, the common date line and the pixel electrode and the thin film transistor located at the (I+1)th row and the (J+1)th column form a shape of substantially "Z", in which I and J are both integers greater than zero.

For the liquid crystal panel with the normal array arrangement, a flicker test pattern of 1+2H is typically used to perform the flicker testing on the liquid crystal panel because the flicker may be enhanced by the flicker test pattern such that the flicker can be easily captured. If the flicker is reduced by adjusting the voltages of common electrodes, the flicker will become lower in a normal display pattern. The flicker test pattern of 1+2H needs to be used in conjunction with the pixel electrode polarity arrangement as shown in FIG. 3, in which RGB represents three colors of red, green and blue respectively, and the positive sign and the negative sign represent two polarities of one pixel electrode. In particular, on one hand, any two adjacent columns of pixel electrodes have opposed polarities; on the other hand, the first row of pixel electrode has the same polarity as the last row. Starting from the second row of pixel electrode, each two of rows of pixel electrodes are in sequence set as one group. In the odd groups of pixel electrodes, each row of pixel electrode and the first row of pixel electrode have opposed polarities; while in the even groups of pixel electrodes, each row of pixel electrode and the first row of pixel electrode have the same polarity. The liquid crystal panel with the normal array arrangement employs polarity inversion driving signals as shown in FIG. 4 to achieve the pixel electrode polarity arrangement which the flicker test pattern of 1+2H is used in conjunction with, in which a high level represents a constant polarity, while a low level represents an inversion polarity. That is, in one frame, the polarity is inversed after the first row is scanned, and then the polarity is inversed after each two rows, from the second row to the last row but one, are scanned. The last row and the first row have the same level, and the initial data line driving signals for two adjacent frames of pictures have opposed polarities.

In the liquid crystal panel with the normal array arrangement, the pixel electrode polarity arrangement is formed by the polarity inversion mode of column inversion in which the pixel electrodes in one column have the same polarity while those in two adjacent columns have opposed polarities. On the other hand, for the liquid crystal panel with the Z inversion array arrangement, if the polarity inversion mode of column inversion is used, the pixel electrode polarity arrangement as shown in FIG. 5 in which any two adjacent pixel electrodes have opposed polarities is arrived due to the distinction of the Z inversion array arrangement from the normal array arrangement. Further, because it is not in conformity with the pixel electrode polarity arrangement required for the flicker test pattern of 1+2H, it is impossible to use the flicker test pattern of 1+2H to perform the flicker testing on the liquid crystal panel with Z inversion array arrangement.

SUMMARY OF THE INVENTION

The present invention has been made to overcome or alleviate at least one aspect of the above mentioned disadvantages.

The present invention provides, in exemplary embodiments, a method for driving the liquid crystal panel, a method for testing flicker and a liquid crystal display apparatus, which may use the flicker test pattern of 1+2H to perform the flicker testing on the liquid crystal panel with the Z inversion array arrangement by means of changing the driving modes of polarity inversion.

According to an aspect of the present invention, a method for driving the liquid crystal panel is provided. The liquid crystal panel includes a plurality of data lines and a plurality of gate lines which are crossed respectively to form a plurality of pixel units in rectangular arrangement. Each of the plurality of pixel units includes one thin film transistor and one pixel electrode. In two adjacent columns of pixel units in the plurality of pixel units, one column common data line is connected with the pixel electrodes located on the opposed sides of the common data line alternatively through the thin film transistors. The method for driving the liquid crystal panel includes:

applying data line driving signals with opposed polarities to the odd columns of data lines and the even columns of data lines, respectively, within one frame of picture, wherein the polarities of the data line driving signals are inversed, each time two rows of the gate lines have been scanned, to form a specific polarity arrangement, and the initial data line driving signals for two adjacent frames of pictures have opposed polarities, wherein the specific polarity arrangement is configured such that the first row of pixel electrode and the last row of pixel electrode have the same polarity and that starting from the second row of pixel electrode, each two rows of pixel electrodes constitute a group of pixel electrodes in sequence, in which each row of the pixel electrodes in the odd groups of pixel electrodes have a polarity opposed to that of the first row of the pixel electrodes while each row of the pixel electrodes in the even groups of pixel electrodes have the same polarity as the first row of the pixel electrodes.

According to another aspect of the present invention, a method for testing flicker of the liquid crystal panel is provided. The liquid crystal panel includes a plurality of data lines and a plurality of gate lines which are crossed respectively to form a plurality of pixel units in rectangular arrangement. Each of the plurality of pixel units includes one thin film transistor and one pixel electrode. In two adjacent columns of pixel units in the plurality of pixel units, one column common data line connects the thin film transistors with the pixel electrodes on the opposed sides of the common data line alternatively. The method for testing flicker of the liquid crystal panel includes:

displaying a flicker test pattern on the liquid crystal panel;

detecting and determining whether the pattern displayed on the liquid crystal panel is the flicker test pattern which needs to be used in conjunction with a specific polarity arrangement, the specific polarity arrangement being configured such that the first row of pixel electrode and the last row of pixel electrode have the same polarity and that starting from the second row of pixel electrode, each two rows of pixel electrodes constitute a group of pixel electrodes in sequence, in which each row of the pixel electrodes in the odd groups of pixel electrodes have a polarity opposed to that of the first row of the pixel electrodes while each row of the pixel electrodes in the even groups of pixel electrodes have the same polarity as the first row of the pixel electrodes;

converting the driving mode of the liquid crystal panel by a converting method, the converting method including: applying data line driving signals with opposed polarities to the odd columns of data lines and the even columns of data lines, respectively, wherein, within one frame of picture, the polarities of the data line driving signals are inversed, each time two rows of the gate lines have been scanned, to form a specific polarity arrangement, and the initial data line driving signals for two adjacent frames of pictures have opposed polarities; and detecting the flicker level or extent of the liquid crystal panel.

According to a further aspect of the present invention, a liquid crystal display apparatus is provided. The liquid crystal display apparatus includes:

a liquid crystal panel including a plurality of data lines and a plurality of gate lines which are crossed respectively to form a plurality of pixel units in rectangular arrangement, each of the plurality of pixel units including one thin film transistor and one pixel electrode, in two adjacent columns of pixel units in the plurality of pixel units, one column common data line connecting the thin film transistors with the pixel electrodes on the opposed sides of the common data line alternatively;

a source driver IC to which the plurality of data lines are connected, the source driver IC being configured to provide the data line driving signals with opposed polarities to the odd columns of data lines and the even columns of data lines;

a polarity control unit connected to the source driver IC, the polarity control unit being configured, within one frame of picture, to inverse the polarities of the data line driving signals each time two rows of the gate lines have been scanned to form the specific polarity arrangement, and configured to make the initial data line driving signals for two adjacent frames of pictures have opposed polarities, wherein the specific polarity arrangement is configured such that the first row of pixel electrode and the last row of pixel electrode have the same polarity and that starting from the second row of pixel electrode, each two rows of pixel electrodes constitute a group of pixel electrodes in sequence, in which each row of the pixel electrodes in the odd groups of pixel electrodes have a polarity opposed to that of the first row of the pixel electrodes while each row of the pixel electrodes in the even groups of pixel electrodes have the same polarity as the first row of the pixel electrodes.

BRIEF DESCRIPTION OF THE DRAWINGS

In order to explain the technical solutions in the embodiments of the present invention or in the prior art more explicitly, the figures for the embodiments of the present invention or the prior art will be introduced briefly below. The above and other features of the present invention will become more apparent by describing in detail exemplary embodiments thereof with reference to the accompanying drawings, in which:

FIG. 3 is a schematic view of the pixel electrode polarity arrangement used in conjunction with a flicker test pattern of 1+2H in the prior art;

FIG. 4 is a waveform graph of driving signals for achieving the polarity arrangements as shown in FIG. 3 in the liquid crystal panel with the normal array arrangement in the prior art;

FIG. 5 is a schematic view showing the polarity arrangement of the pixel electrodes obtained by the liquid crystal panel with the Z inversion array arrangement by means of column inversion in the prior art;

FIG. 6 is a schematic view in principle showing the implementation of the polarity inversion of the liquid crystal panel with the Z inversion array arrangement in use normally without performing the flicker test according to an exemplary embodiment of the present invention;

FIG. 7 is a waveform graph of driving signals for achieving the polarity inversion as shown in FIG. 6;

FIG. 8 is a waveform graph of driving signals for achieving the polarity inversion of the liquid crystal panel with the Z inversion array arrangement upon testing the flicker according to an exemplary embodiment of the present invention;

DETAILED DESCRIPTION OF PREFERRED EMBODIMENTS OF THE INVENTION

Figure 1:
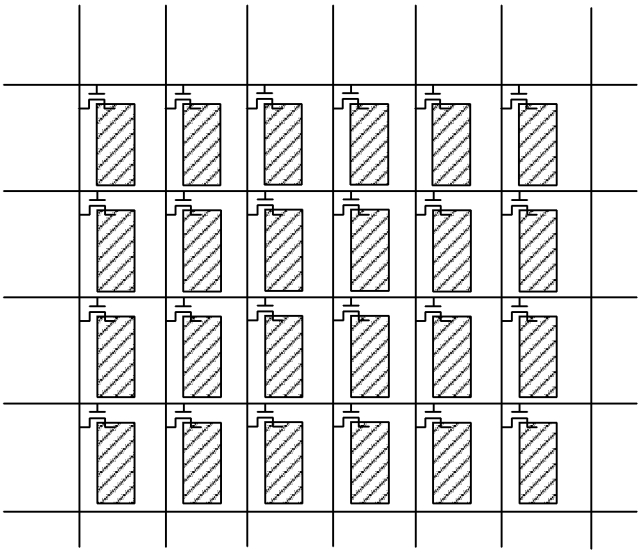
Fig. 1 Prior Art
FIG. 1 is a schematic view showing a principle of an array substrate with the normal array arrangement in the prior art.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
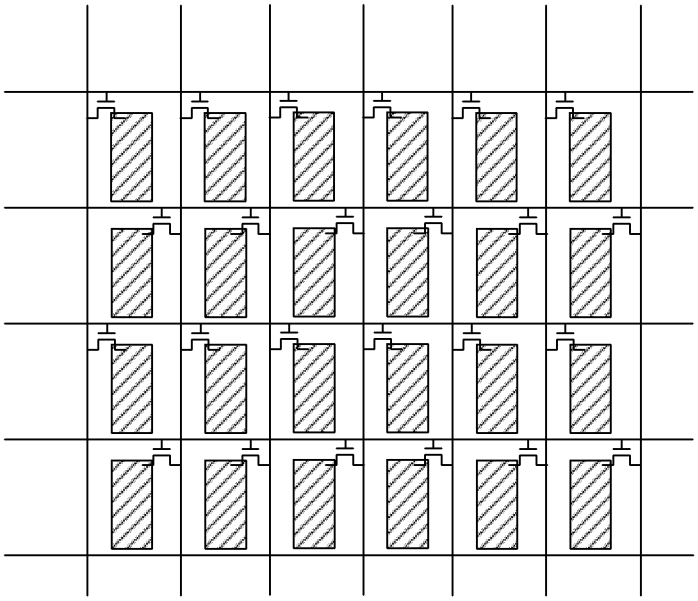
Fig. 2 Prior Art
FIG. 2 is a schematic view showing a principle of an array substrate with the Z inversion array arrangement in the prior art.

In an embodiment of the present invention, a method for driving the liquid crystal panel is provided. As shown in FIG. 2, the above liquid crystal panel includes a plurality of data lines and a plurality of gate lines which are crossed respectively to form a plurality of pixel units in rectangular arrangement. Each of the plurality of pixel units includes one thin film transistor and one pixel electrode. In two adjacent columns of pixel units in the plurality of pixel units, one column common data line is connected with the pixel electrodes located on the opposed sides of the common data line alternatively through the thin film transistors. In this way, the pixel electrode and the thin film transistor located at the Ith row and the Jth column, the common date line and the pixel electrode and the thin film transistor located at the (I+1)th row and the (J+1)th column form a shape of substantially "Z", in which I and J are both integers greater than zero. The above method for driving the liquid crystal panel includes steps of:

applying the data line driving signals with opposed polarities to the odd columns of data lines and the even columns of data lines, respectively.

wherein, within one frame of picture, the polarities of the data line driving signals are inversed, each time two rows of the gate lines have been scanned, to form a specific polarity arrangement, and the initial data line driving signals for two adjacent frames of pictures have opposed polarities.

In particular, as shown in FIG. 6, in the polarity inversion mode of the column inversion, normally in use, without performing the flicker test, it is achieved that the polarities of the driving signals for the polarity inversion in the liquid crystal panel with the Z inversion array arrangement can be inversed by taking the frame as period. That is, the pixel electrodes of the Nth frame and those of the (N+1)th frame have polarities completely opposed to each other. FIG. 7 shows the waveform graph of the driving signals for the polarity inversion as shown in FIG. 6, in which the high level represents a constant polarity while the low level represents an inverse polarity. In the Nth frame, the driving signal is the high level, i.e., all of the pixel electrodes have constant polarities in the Nth frame. In the (N+1)th frame, the driving signal is the low level, i.e., all of the pixel electrodes have inverse polarities in the (N+1) th frame.

As the pixel electrodes with such polarity inversion have a polarity arrangement not in conformity with the polarity arrangement required for the flicker test pattern of 1+2H as shown in FIG. 3, the polarity inversion is achieved by the driving signals of the waveform shown in FIG. 8 upon performing the flicker test on the liquid crystal panel with the Z inversion array arrangement according to the exemplary embodiment of the present invention. In the waveform graph of the driving signals shown in FIG. 8, the high level represents a constant polarity while the low level represents an inverse polarity, i.e., the polarities of the pixel electrodes are inversed each time two rows are scanned within one frame, and the initial data line driving signals of two adjacent frames of pictures have polarities opposed to each other such that each pixel electrode has opposed polarities in two adjacent frames.

Figure 9:
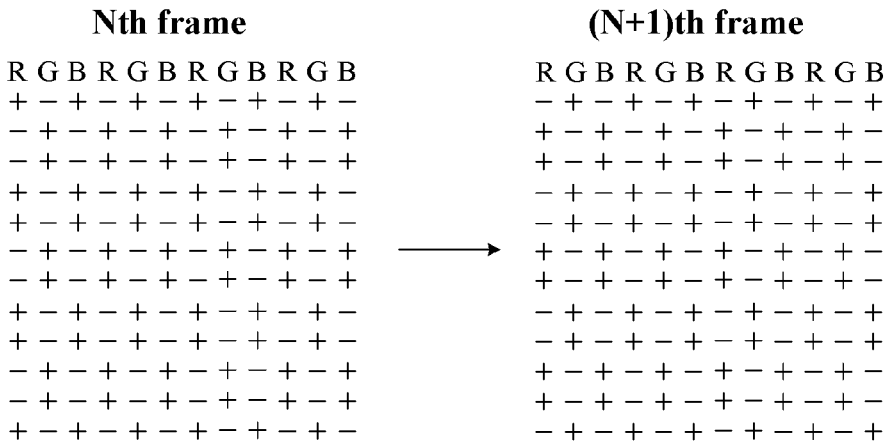
FIG. 9 is a schematic view in principle showing the specific polarity arrangement obtained in the liquid crystal panel with the Z inversion array arrangement by means of the driving signals having the waveform as shown in FIG. 8.

FIG. 9 shows in principle the specific polarity arrangement obtained in the liquid crystal panel with the Z inversion array arrangement by means of the driving signals of waves as shown in FIG. 8. With reference to FIG. 9, the specific polarity arrangement is configured such that the first row of pixel electrodes and the last row of pixel electrodes have the same polarity and that starting from the second row of pixel electrodes, each two rows of pixel electrodes constitute a group of pixel electrodes in sequence, in which each row of the pixel electrodes in the odd groups of pixel electrodes have a polarity opposed to that of the first row of the pixel electrodes, while each row of the pixel electrodes in the even groups of pixel electrodes have the same polarity as the first row of the pixel electrodes. Such specific polarity arrangement is in conformity with the pixel electrode polarity arrangement required for the flicker test pattern of 1+2H as shown in FIG. 3, thus, the flicker test pattern of 1+2H may be used to perform the flicker test on the liquid crystal panel with the Z inversion array arrangement.

In the method of driving the liquid crystal panel in accordance with the embodiment of the present invention, each time two gate lines are scanned, the polarities of the data line driving signals are inversed such that the liquid crystal panel with the Z inversion array arrangement generates the specific polarity arrangement which is in conformity with the pixel electrode polarity arrangement required for the flicker test pattern of 1+2H. Thus, the flicker test may be performed on the liquid crystal panel with the Z inversion array arrangement on basis of the flicker test pattern of 1+2H.

Figure 10:
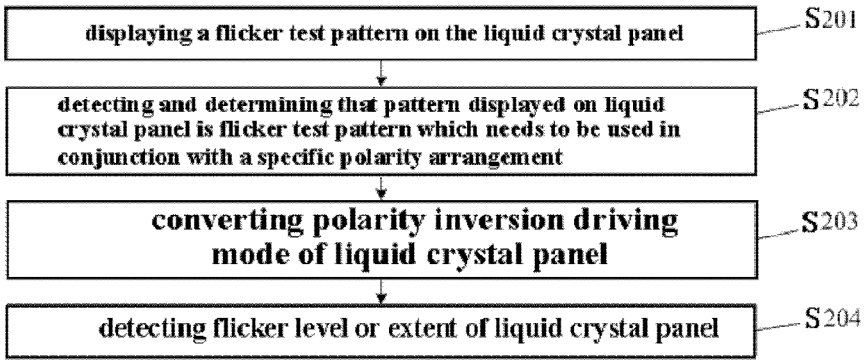
FIG. 10 is a flow chart of a method for testing flicker of the liquid crystal panel according to a first exemplary embodiment of the present invention.

In a further exemplary embodiment of the present invention, a method for testing flicker of the liquid crystal panel is provided. As shown in FIG. 2, the above liquid crystal panel has the Z inversion array arrangement and includes a plurality of data lines and a plurality of gate lines which are crossed respectively to form a plurality of pixel units in rectangular arrangement. Each of the plurality of pixel units includes one thin film transistor and one pixel electrode. In two adjacent columns of pixel units in the plurality of pixel units, one column common data line is connected with the pixel electrodes located on the opposed sides of the common data line alternatively through the thin film transistors. In this way, the pixel electrode and the thin film transistor located at the Ith row and the Jth column, the common date line and the pixel electrode and the thin film transistor located at the (I+1)th row and the (J+1)th column form a shape of substantially "Z", in which I and J are both integers greater than zero. As shown in FIG. 10, the above method for driving the liquid crystal panel includes steps of:

S201: displaying a flicker test pattern on the liquid crystal panel;

S202: detecting and determining that the pattern displayed on the liquid crystal panel is the flicker test pattern which needs to be used in conjunction with a specific polarity arrangement, i.e., the flicker test pattern of 1+2H, in particular, as shown in FIG. 9, the specific polarity arrangement being configured such that the first row of pixel electrodes and the last row of pixel electrodes have the same polarity and that starting from the second row of pixel electrodes, each two rows of pixel electrodes constitute a group of pixel electrodes in sequence, in which each row of the pixel electrodes in the odd groups of pixel electrodes have a polarity opposed to that of the first row of the pixel electrodes, while each row of the pixel electrodes in the even groups of pixel electrodes have the same polarity as the first row of the pixel electrodes;

S203: converting the polarity inversion driving mode of the liquid crystal panel by the driving method as described in the above embodiments, i.e., applying the data line driving signals with opposed polarities to the odd columns of data lines and the even columns of data lines, respectively.

wherein, within one frame of picture, the polarities of the data line driving signals are inversed, each time two rows of the gate lines have been scanned, to form the specific polarity arrangement, the initial data line driving signals for two adjacent frames of pictures have opposed polarities; and S204: detecting the flicker level or extent of the liquid crystal panel.

In particular, like the conventional flicker test on the liquid crystal panel with the normal array arrangement, the voltages of the common electrodes may be adjusted depending on the flicker level or extent to reduce the flicker level or extent.

In the method of testing flicker of the liquid crystal panel in accordance with the embodiment of the present invention, each time two gate lines are scanned, the polarities of the data line driving signals are inversed such that the liquid crystal panel with the Z inversion array arrangement generates the specific polarity arrangement which is in conformity with the pixel electrode polarity arrangement required for the flicker test pattern of 1+2H. Thus, the flicker test may be performed on the liquid crystal panel with the Z inversion array arrangement on basis of the flicker test pattern of 1+2H.

Figure 11:
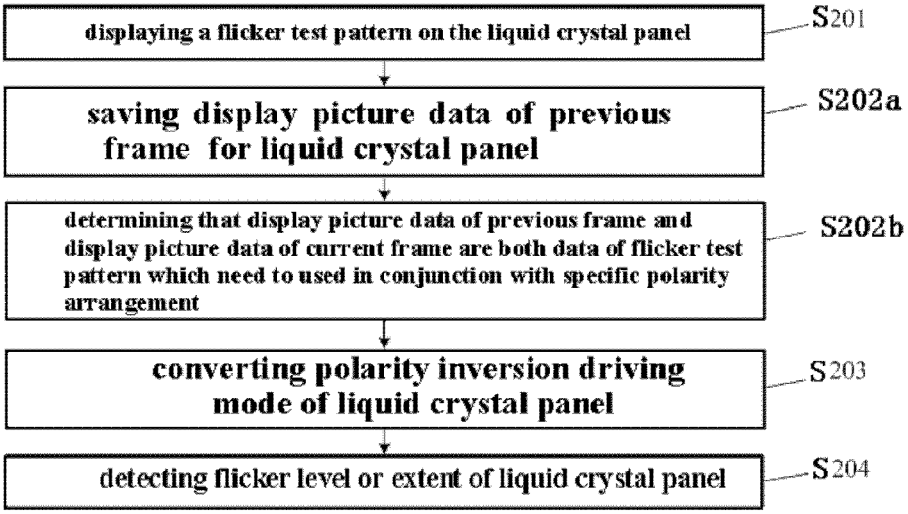
FIG. 11 is a flow chart of a method for testing flicker of the liquid crystal panel according to a second exemplary embodiment of the present invention.

Furthermore, as shown in FIG. 11, in S202 of detecting and determining that the pattern displayed on the liquid crystal panel is the flicker test pattern which needs to be used in conjunction with a specific polarity arrangement further includes steps of:

S202*a*: saving the display picture data of the previous frame for the liquid crystal panel;

S202*b*: determining that the display picture data of the previous frame and the display picture data of the current frame are both the data of the flicker test pattern which need to be used in conjunction with the specific polarity arrangement.

Specifically, if it is determined by comparison that the previous frame and the current frame have same display picture data which are data of flicker test pattern of 1+2H, it will be determined that the flicker test is being performed on the liquid crystal panel on basis of the flicker test pattern of 1+2H; then the current polarity inversion driving mode of the liquid crystal panel is converted to make the polarity arrangement of the pixel electrodes of the liquid crystal panel be in conformity with the polarity arrangement of the pixel electrodes required for the flicker test pattern of 1+2H, so as to perform the flicker test on the liquid crystal panel with the Z inversion array arrangement. After the flicker test ends, for example, it is detected that the above liquid crystal panel fails to display the flicker test pattern of 1+2H, the driving mode for achieving polarity inversion may be converted into the normal driving mode by taking frame as period, such that the liquid crystal panel with the Z inversion array arrangement may display normally.

It should be noted that in theory, as long as the display picture data of one frame is determined as the data of the flicker test pattern of 1+2H, it can be determined that the flicker test is being performed on the liquid crystal panel on basis of the flicker test pattern of 1+2H. However, in order to avoid errors, two or more frames of display picture data may be compared and if all of the display picture date of the multiple frames are the data of the flicker test pattern of 1+2H, it will be determined that the flicker test is being performed on the liquid crystal panel on basis of the flicker test pattern of 1+2H.

In the method of testing flicker of the liquid crystal panel in the embodiment of the present invention, each time two gate lines are scanned, the polarities of the data line driving signals are inversed such that the liquid crystal panel with the Z inversion array arrangement generates the specific polarity arrangement which is in conformity with the pixel electrode polarity arrangement required for the flicker test pattern of 1+2H. Thus, the flicker test may be performed on the liquid crystal panel with the Z inversion array arrangement on basis of the flicker test pattern of 1+2H.

Figure 12:
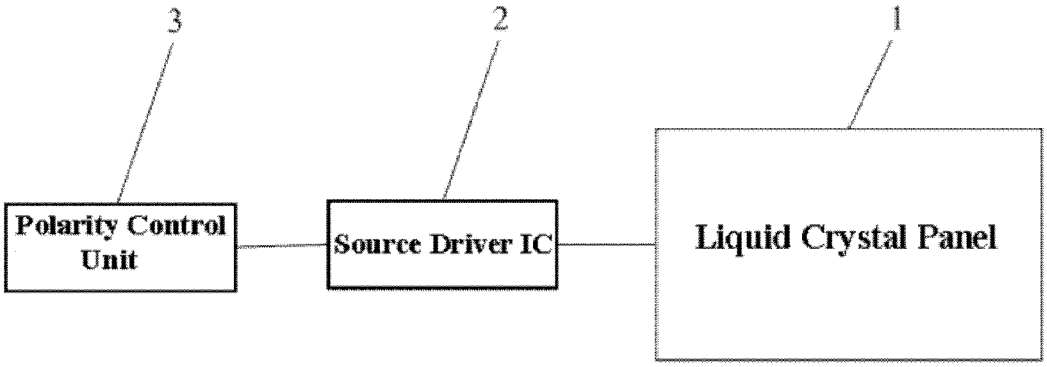
FIG. 12 is a block diagram of a liquid crystal display apparatus according to a first exemplary embodiment of the present invention.

As shown in FIG. 12, in a further exemplary embodiment of the present invention, a liquid crystal display apparatus is provided. The liquid crystal display apparatus includes a liquid crystal panel 1 with the Z inversion array arrangement and a source driver IC 2. More specifically, as shown in FIG. 2, the above liquid crystal panel with the Z inversion array arrangement includes a plurality of data lines and a plurality of gate lines which are crossed respectively to form a plurality of pixel units in rectangular arrangement. Each of the plurality of pixel units includes one thin film transistor and one pixel electrode. In two adjacent columns of pixel units in the plurality of pixel units, one column common data line is connected with the pixel electrodes on the opposed sides of the common data line alternatively through the thin film transistors. The plurality of data lines are connected to the source driver IC which is configured to provide the data line driving signals with opposed polarities to the odd columns of data lines and the even columns of data lines, respectively.

As illustrated in FIG. 12, the above liquid crystal display apparatus further includes a polarity control unit 3 connected to the source driver IC 2, the polarity control unit 3 being configured, within one frame of picture, to inverse the polarities of the data line driving signals each time two rows of the gate lines have been scanned so that the specific polarity arrangement is formed, and configured to make the initial data line driving signals for two adjacent frames of pictures have opposed polarities.

As illustrated in FIG. 9, the specific polarity arrangement is configured such that the first row of pixel electrodes and the last row of pixel electrodes have the same polarity and that starting from the second row of pixel electrodes, each two rows of pixel electrodes constitute a group of pixel electrodes in sequence, in which each row of the pixel electrodes in the odd groups of pixel electrodes have a polarity opposed to that of the first row of the pixel electrodes, while each row of the pixel electrodes in the even groups of pixel electrodes have the same polarity as the first row of the pixel electrodes.

The method for testing flicker of the liquid crystal display apparatus may be performed as the above embodiments, therefore, the details of the method are omitted herein.

For the liquid crystal display apparatus in the embodiment of the present invention, each time two gate lines are scanned, the polarities of the data line driving signals are inversed such that the liquid crystal panel with the Z inversion array arrangement generates the specific polarity arrangement which is in conformity with the pixel electrode polarity arrangement required for the flicker test pattern of 1+2H. Thus, the flicker test may be performed on the liquid crystal panel with the Z inversion array arrangement on basis of the flicker test pattern of 1+2H.

Figure 13:
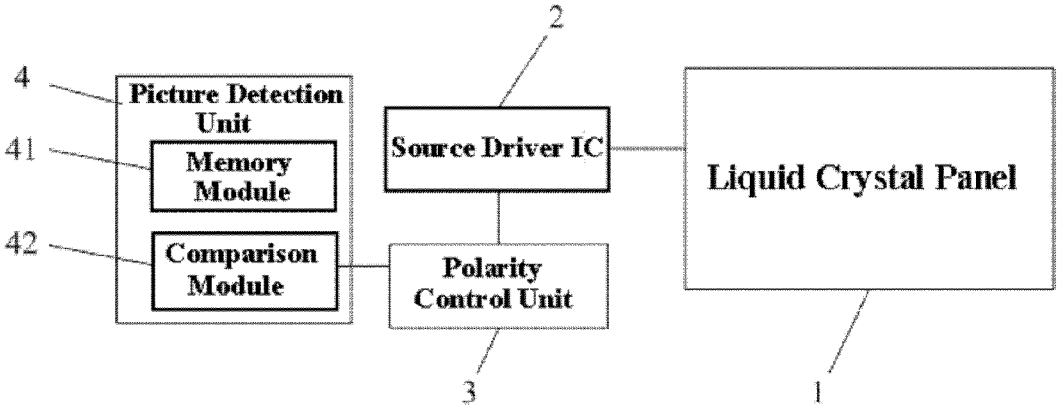
FIG. 13 is a block diagram of a liquid crystal display apparatus according to a second exemplary embodiment of the present invention.

Further, as shown in FIG. 13, the above liquid crystal display apparatus may further include:

a picture detection unit 4 connected to the polarity control unit 3 and configured to detect whether the pattern displayed on the liquid crystal panel 1 is the flicker test pattern which needs to be used in conjunction with the specific polarity arrangement. In an exemplary embodiment, the display picture data transmitted to the liquid crystal panel 1 may also be transmitted to the polarity control unit 3 such that the picture detection unit 4 may detect the display picture of the liquid crystal panel 1 by the display picture data.

Further, if the picture detection unit 4 detects the pattern displayed on the liquid crystal panel 1 is the flicker test pattern which needs to be used in conjunction with the specific polarity arrangement, the polarity control unit 3 will inverse the polarities of the data line driving signals within one frame of picture each time two rows of gate lines are scanned to generate the above specific polarity arrangement such that the initial data line driving signals for two adjacent frames of pictures have polarities opposed to each other.

Further, the picture detection unit 4 includes:

a memory module 41 configured to save the display picture data of the previous frame of the liquid crystal panel 1; and a comparison module 42 connected to the memory module 41 and the polarity control unit 3 and configured to receive the display picture data of the previous frame and the display picture data of the current frame, wherein it will be determined that the pattern displayed on the liquid crystal panel 1 is the flicker test pattern which needs to be used in conjunction with the above specific polarity arrangement if the display picture data of the previous frame and the display picture data of the current frame are data of the flicker test pattern which need to be used in conjunction with the specific polarity arrangement.

Figure 14:
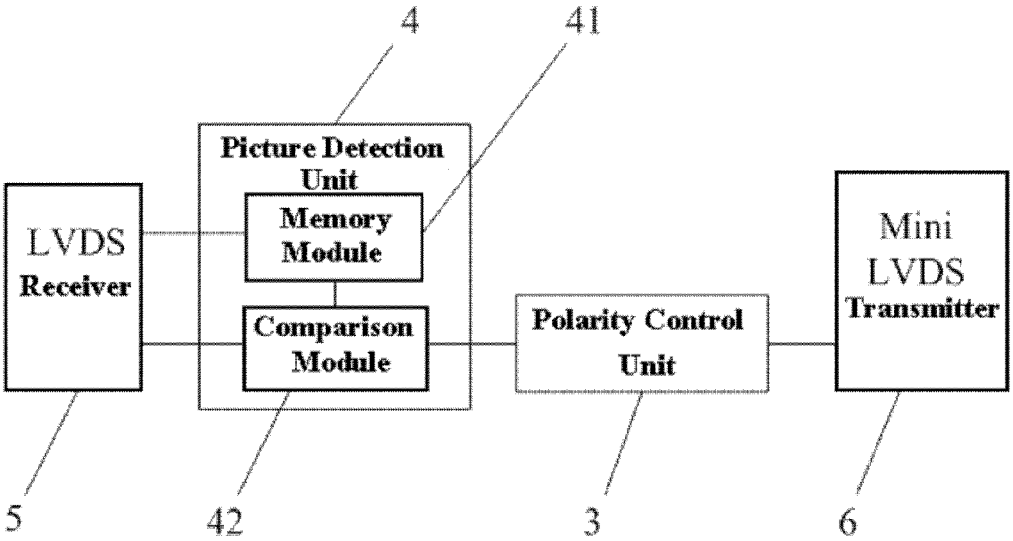
FIG. 14 is a block diagram of TCON according to an exemplary embodiment of the present invention.

In an exemplary embodiment, as illustrated in FIG. 14, the polarity control unit 3 and the picture detection unit 4 may be integrated in a timing controller (TCON) of the liquid crystal display apparatus. Further, the TCON may further include a low-voltage differential signaling (LVDS) receiver 5 which is connected to the picture detection unit 4 and converts the display picture data to be transmitted to the liquid crystal panel from low voltage differential signals to transistor-transistor logic (TTL) signals. Further, the memory module 41 is connected to the LVDS receiver 5 to receive the display picture data which need to be transmitted to the liquid crystal panel. The comparison module 42 is connected to the memory module 41 and the LVDS receiver 5 to receive the display picture data of the previous frame and the display picture data of the current frame saved in the memory module 41. The polarity control unit 3 is connected to the comparison module 42 and a Mini LVDS transmitter 6. If the comparison module 42 determines that the pattern displayed on the liquid crystal panel is the flicker test pattern which needs to be used in conjunction with the above specific polarity arrangement, the polarity control unit 3 will generate new driving signals for polarity inversion and transmit the new driving signals to the Mini LVDS transmitter 6. The Mini LVDS transmitter 6 is connected to the source driver IC in the liquid crystal panel and configured to convert the signals including new driving signals to the packaged format of the Mini LVDS and transmit them to the source driver IC. The source driver IC controls the polarity inversion of the pixel electrode in the liquid crystal panel according to the new driving signals, i.e., convert the driving mode of liquid crystal panel by the driving method in the above embodiments.

The method for testing flicker of the liquid crystal display apparatus may be performed as the above embodiments, therefore, the details of the method are omitted here.

For the liquid crystal display apparatus in the embodiment of the present invention, each time two gate lines are scanned, the polarities of the data line driving signals are inversed such that the liquid crystal panel with the Z inversion array arrangement generates the specific polarity arrangement which is in conformity with the pixel electrode polarity arrangement required for the flicker test pattern of 1+2H. Thus, the flicker test may be performed on the liquid crystal panel with the Z inversion array arrangement on basis of the flicker test pattern of 1+2H.

With reference to the above embodiments, the skilled person in the art will envisage that the present invention may be implemented by the combination of software with necessary generic hardware, however, it may also be implemented only by hardware though the former is preferred in various applications. In view of this, the technical concept of the present invention in essential or its parts making over the prior art may be embodied in form of software products. The computer software products may be stored in readable storage media, such as soft disks, hard disks or optical disks of the computer, including several instructions for allowing a computer apparatus (may be a personal computer, server or network apparatus) to perform the method according to the respective embodiments of the present invention.

The above embodiments are only illustrative, instead of limiting the present invention. Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A method for driving a liquid crystal panel, the liquid crystal panel comprising a plurality of data lines and a plurality of gate lines which are crossed respectively to form a plurality of pixel units in rectangular arrangement, each of the plurality of pixel units comprising one thin film transistor and one pixel electrode, wherein in two adjacent columns of pixel units in the plurality of pixel units, one column common data line is connected with the pixel electrodes located at the opposed sides of the common data line alternatively through the thin film transistors, the method for driving the liquid crystal panel comprising:

applying data line driving signals with opposed polarities to the odd columns of data lines and the even columns of data lines, respectively, within one frame of picture, wherein the polarities of the data line driving signals are inversed, each time two rows of the gate lines have been scanned, to form a specific polarity arrangement, and the initial data line driving signals for two adjacent frames of pictures have opposed polarities, wherein the specific polarity arrangement is configured such that the first row of pixel electrodes and the last row of pixel electrodes have the same polarity and that starting from the second row of pixel electrodes, each two rows of pixel electrodes constituting a group of pixel electrodes in sequence, in which each row of the pixel electrodes in the odd groups of pixel electrodes have a polarity opposed to that of the first row of the pixel electrodes, while each row of the pixel electrodes in the even groups of pixel electrodes have the same polarity as the first row of the pixel electrodes.

2. A method for testing flicker of the liquid crystal panel, the liquid crystal panel comprising a plurality of data lines and a plurality of gate lines which are crossed respectively to form a plurality of pixel units in rectangular arrangement, each of the plurality of pixel units comprising one thin film transistor and one pixel electrode, wherein in two adjacent columns of pixel units in the plurality of pixel units, one column common data line is connected with the pixel electrodes located on the opposed sides of the common data line alternatively through the thin film transistors, the method for testing flicker of the liquid crystal panel comprises:

displaying a flicker test pattern on the liquid crystal panel;

detecting and determining that the pattern displayed on the liquid crystal panel is the flicker test pattern which needs to be used in conjunction with a specific polarity arrangement, the specific polarity arrangement being configured such that the first row of pixel electrodes and the last row of pixel electrodes have the same polarity and that starting from the second row of pixel electrodes, each two rows of pixel electrodes constituting a group of pixel electrodes in sequence, in which each row of the pixel electrodes in the odd groups of pixel electrodes have a polarity opposed to that of the first row of the pixel electrodes, while each row of the pixel electrodes in the even groups of pixel electrodes have the same polarity as the first row of the pixel electrodes;

converting the driving mode of the liquid crystal panel by a converting method comprising: applying data line driving signals with opposed polarities to the odd columns of data lines and the even columns of data lines, respectively, within one frame of picture, wherein the polarities of the data line driving signals are inversed, each time two rows of the gate lines have been scanned, to form a specific polarity arrangement, and the initial data line driving signals for two adjacent frames of pictures have opposed polarities; and detecting the flicker level or extent of the liquid crystal panel.

3. The method according to claim 2, wherein the step of detecting and determining that the pattern displayed on the liquid crystal panel is the flicker test pattern which needs to be used in conjunction with a specific polarity arrangement comprises:

saving the display picture data of the previous frame for the liquid crystal panel; and determining whether the display picture data of the previous frame and the display picture data of the current frame are both the data of the flicker test pattern which need to be used in conjunction with the specific polarity arrangement.

4. A liquid crystal display apparatus comprising:

a liquid crystal panel comprising a plurality of data lines and a plurality of gate lines which are crossed respectively to form a plurality of pixel units in rectangular arrangement, each of the plurality of pixel units comprising one thin film transistor and one pixel electrode, wherein in two adjacent columns of pixel units in the plurality of pixel units, one column common data line is connected with the pixel electrodes located at the opposed sides of the common data line alternatively through the thin film transistors;

a source driver IC (Integrated Circuit) to which the plurality of data lines are connected, the source driver IC being configured to provide the data line driving signals with opposed polarities to the odd columns of data lines and the even columns of data lines; and a polarity control unit connected to the source driver IC, the polarity control unit being configured, within one frame of picture, to inverse the polarities of the data line driving signals each time two rows of the gate lines have been scanned to form the specific polarity arrangement, and configured to make the initial data line driving signals for two adjacent frames of pictures have opposed polarities, wherein the specific polarity arrangement is configured such that the first row of pixel electrodes and the last row of pixel electrodes have the same polarity and that starting from the second row of pixel electrodes, each two rows of pixel electrodes constituting a group of pixel electrodes in sequence, in which each row of the pixel electrodes in the odd groups of pixel electrodes have a polarity opposed to that of the first row of the pixel electrodes while each row of the pixel electrodes in the even groups of pixel electrodes have the same polarity as the first row of the pixel electrodes.

5. The liquid crystal display apparatus according to claim 4, further comprising:

a picture detection unit connected to the polarity control unit and configured to detect whether the pattern displayed on the liquid crystal panel is the flicker test pattern which needs to be used in conjunction with the specific polarities arrangement, wherein, if the picture detection unit detects the pattern displayed on the liquid crystal panel is the flicker test pattern which needs to be used in conjunction with the specific polarity arrangement, the polarity control unit is configured to control the polarities of the data line driving signals, in response to the picture detection unit detecting the pattern displayed on the liquid crystal panel is the flicker test pattern which needs to be used in conjunction with the specific polarity arrangement, to be inversed within one frame of picture each time two rows of the gate lines are scanned to generate the specific polarity arrangement, such that the initial data line driving signals for two adjacent frames of pictures have polarities opposed to each other.

6. The liquid crystal display apparatus according to claim 5, wherein the picture detection unit comprises:

a memory module configured to save the display picture data of the previous frame of the liquid crystal panel; and a comparison module connected to the memory module and the polarity control unit and configured to determine that the pattern displayed on the liquid crystal panel is the flicker test pattern which needs to be used in conjunction with the above specific polarity arrangement, if the display picture data of the previous frame and the display picture data of the current frame are data of the flicker test pattern which need to be used in conjunction with the specific polarity arrangement.

* * * * *